US012532972B2

(12) United States Patent
Choi

(10) Patent No.: US 12,532,972 B2
(45) Date of Patent: Jan. 27, 2026

(54) ADJUSTABLE BED FRAME

(71) Applicant: Inno-Sports Co., Ltd., Xiamen (CN)

(72) Inventor: Kwan Jun Choi, Xiamen (CN)

(73) Assignee: Inno-Sports Co., Ltd., Xiamen (CN)

( * ) Notice: Subject to any disclaimer, the term of this patent is extended or adjusted under 35 U.S.C. 154(b) by 283 days.

(21) Appl. No.: 18/325,710

(22) Filed: May 30, 2023

(65) Prior Publication Data

US 2023/0404276 A1 Dec. 21, 2023

(30) Foreign Application Priority Data

Jun. 20, 2022 (CN) ..... 202221545018.6

(51) Int. Cl.
*A47C 20/04* (2006.01)

(52) U.S. Cl.
CPC ..... *A47C 20/041* (2013.01)

(58) Field of Classification Search
CPC ..... A47C 20/041
USPC ..... 5/618
See application file for complete search history.

(56) References Cited

U.S. PATENT DOCUMENTS 5,537,701 A * 7/1996 Elliott ..... A61G 7/015 5/616
5,640,730 A * 6/1997 Godette ..... A47C 20/041 5/617
2005/0120481 A1* 6/2005 Farmont ..... A47C 20/041 5/613
2010/0125953 A1* 5/2010 Nagaoka ..... A61G 7/015 700/275
2020/0205576 A1* 7/2020 Choi ..... A47C 20/041
2021/0368993 A1* 12/2021 Wang ..... A47C 20/041

* cited by examiner

*Primary Examiner* — Myles A Throop
(74) *Attorney, Agent, or Firm* — MORGAN, LEWIS & BOCKIUS LLP

(57) ABSTRACT

An adjustable bed frame includes one or more structures, each having a mounting unit, a leg unit, a support unit and a driving unit. The leg unit includes a sloped surface. The support unit comprises first, second and third segments. The first segment is rotatable relative to the mounting unit by the first driving unit. The second segment is pivotally coupled with the first segment. The third segment has an upper portion fixed with the second segment and a lower portion abutting the sloped surface of the leg unit. As the first segment rotates relative to the mounting unit, the third segment moves along the sloped surface of the leg unit. By abutting on the sloped surface of the leg unit, the third segment defines, at least in part, a slope of the second segment, and helps to retain the support unit in position.

20 Claims, 7 Drawing Sheets

ADJUSTABLE BED FRAME

CROSS-REFERENCE TO RELATED APPLICATIONS

The present application claims priority to Chinese Utility Model Application CN 202221545018.6 filed Jun. 20, 2022. The disclosure of the application is incorporated herein for all purposes by reference in its entirety.

FIELD OF THE INVENTION

The present invention generally relates to bed frames, and more particularly, to adjustable bed frames.

BACKGROUND

Existing adjustable bed frames can be roughly divided into two types. Bed frames of one type are often made of hollow steel or plastic tubes that are hinged together and are thus relatively light in weight. In many cases, such bed frames have relatively small functional areas and limited strength. As such, they are mainly used for breaks or temporary rest. Bed frames of the other type are relatively heavy and often include motors for adjustment. Motorized bed frames can provide larger functional areas and stronger support. However, motorized bed frames are in general more complex.

Given the current state of the art, there remains a need for adjustable bed frames that address the abovementioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present invention provides adjustable bed frames that are simple, strong and easy to use.

In various exemplary embodiments, the present invention provides an adjustable bed frame including one or more structures. Each structure includes a mounting unit, a first leg unit, a first support unit and a driving unit. The first leg unit is coupled or formed with the mounting unit at a first side of the adjustable bed frame, and including a first sloped surface. The first support unit includes first, second and third segments, with the first segment rotatable with respect to the mounting unit and the second segment pivotally coupled with the first segment. The third segment has an upper portion fixedly coupled or integrally formed with the second segment and a lower portion abutting the first sloped surface of the first leg unit. The first driving unit is configured to rotate the first segment of the first support unit with respect to the mounting unit. Rotation of the first segment then causes the third segment to move along the first sloped surface of the first leg unit, and abutting of the third segment on the first sloped surface of the first leg unit defines, at least in part, a slope of the second segment.

In some exemplary embodiments, the one or more structures include a pair of structures spaced apart from each other along a width direction of the adjustable bed frame and connected to each other by one or more connecting members.

In some exemplary embodiments, the first segment of the first support unit is pivotally connected to the mounting unit.

In some exemplary embodiments, each structure further includes a first link. In some such embodiments, the first segment is rotated with respect to the mounting unit by the first driving unit via the first link. In an exemplary embodiment, the first link has a substantially fan shape.

In some exemplary embodiments, at least one of the first segment and the first link is pivotally connected to the mounting unit.

In some exemplary embodiments, the first segment and the first link are fixedly coupled or formed with each other.

In some exemplary embodiments, the first segment and the first link are pivotally and coaxially connected to the mounting unit. In some such embodiments, the first segment sits on the first link and is rotatable with respect to the first link in one direction.

In some exemplary embodiments, the first driving unit is disposed at the mounting unit. In an exemplary embodiment, the first driving unit includes an electric motor.

In some exemplary embodiments, abutting of the third segment on the first sloped surface of the first leg unit helps to retain the first support unit in any desired position between a leveled position and a tilted position.

In some exemplary embodiments, each structure further includes one or more cushioning members disposed between the first leg unit and the first support unit to prevent the first support unit from rotating beyond a leveled position.

In some exemplary embodiments, each structure further includes a second leg unit coupled with the mounting unit at a second side of the adjustable bed frame, and a second support unit rotatable with respect to the mounting unit. In an exemplary embodiment, the second support unit is pivotally connected to the mounting unit.

In some embodiments, each structure further includes a second driving unit disposed at the mounting unit to rotate the second support unit with respect to the mounting unit.

In some exemplary embodiments, each structure further includes a second link. In some such embodiments, the second driving unit rotates the second support unit with respect to the mounting unit via the second link.

In some exemplary embodiments, each structure further includes one or more cushioning members disposed between the second leg unit and the second support unit to prevent the second first support unit from rotating beyond a leveled position.

In some exemplary embodiments, the adjustable bed frame further includes: one or more panels supported by the one or more mounting units of the one or more structures, one or more panels supported by the one or more first segments of the one or more first support units of the one or more structures, one or more panels supported by the one or more second segments of the one or more first support units of the one or more structures, one or more panels supported by the one or more second support units of the one or more structures, or any combination thereof.

In some exemplary embodiments, the adjustable bed frame further includes a retainer disposed at a panel in the one or more panels supported by the one or more second segments of the one or more first support units of the one or more structures.

The adjustable bed frames of the present invention have other features and advantages that will be apparent from, or are set forth in more detail in, the accompanying drawings, which are incorporated herein, and the following Detailed Description, which together serve to explain certain principles of exemplary embodiments of the present invention.

BRIEF DESCRIPTION OF THE DRAWINGS

The accompanying drawings, which are incorporated into and constitute a part of this specification, illustrate one or more exemplary embodiments of the present invention and, together with the Detailed Description, serve to explain the principles and implementations of exemplary embodiments of the invention.

Figure 1:
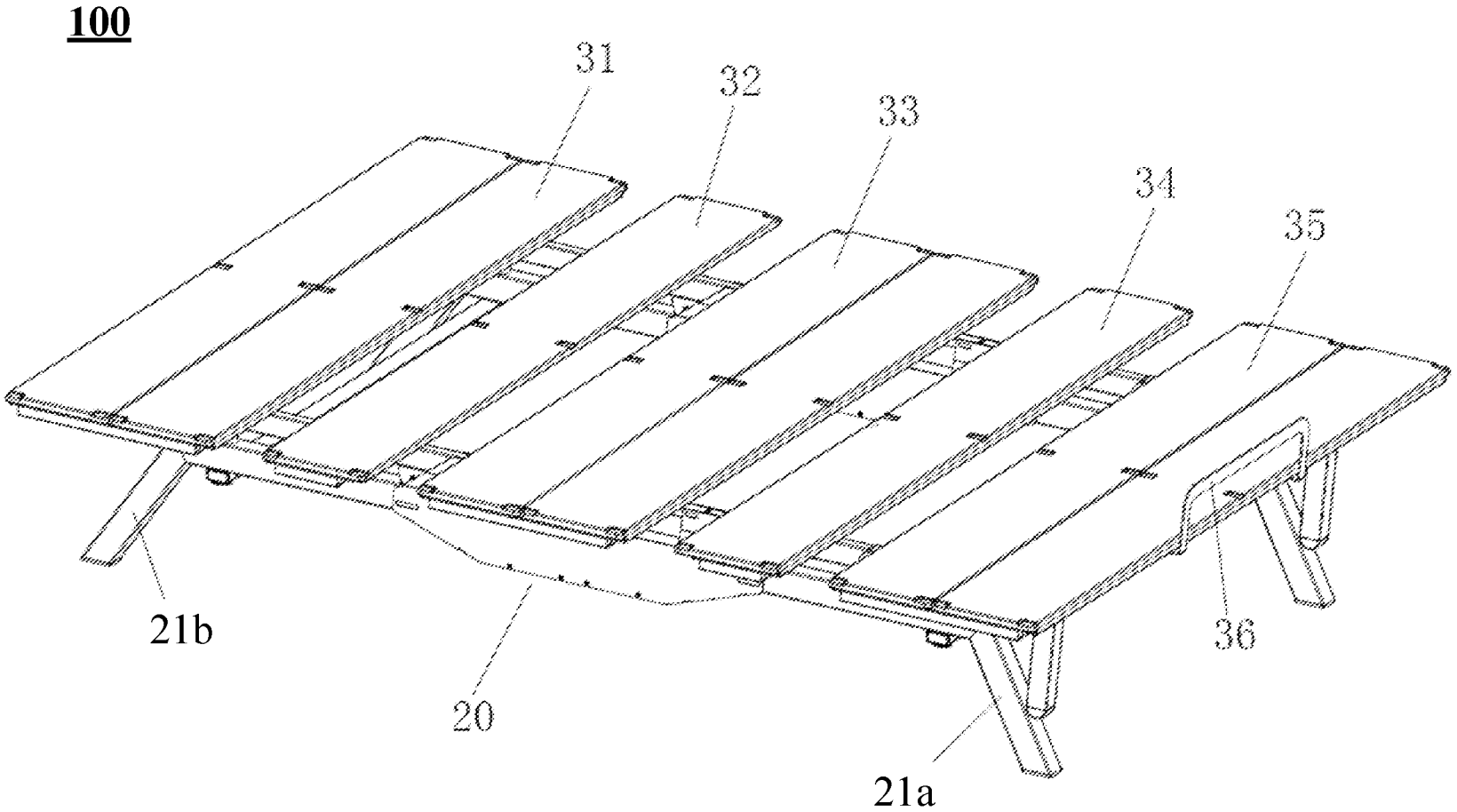
FIG. 1 is a perspective view illustrating an exemplary bed frame in a leveled position in accordance with some exemplary embodiments of the present invention.
Figure 2:
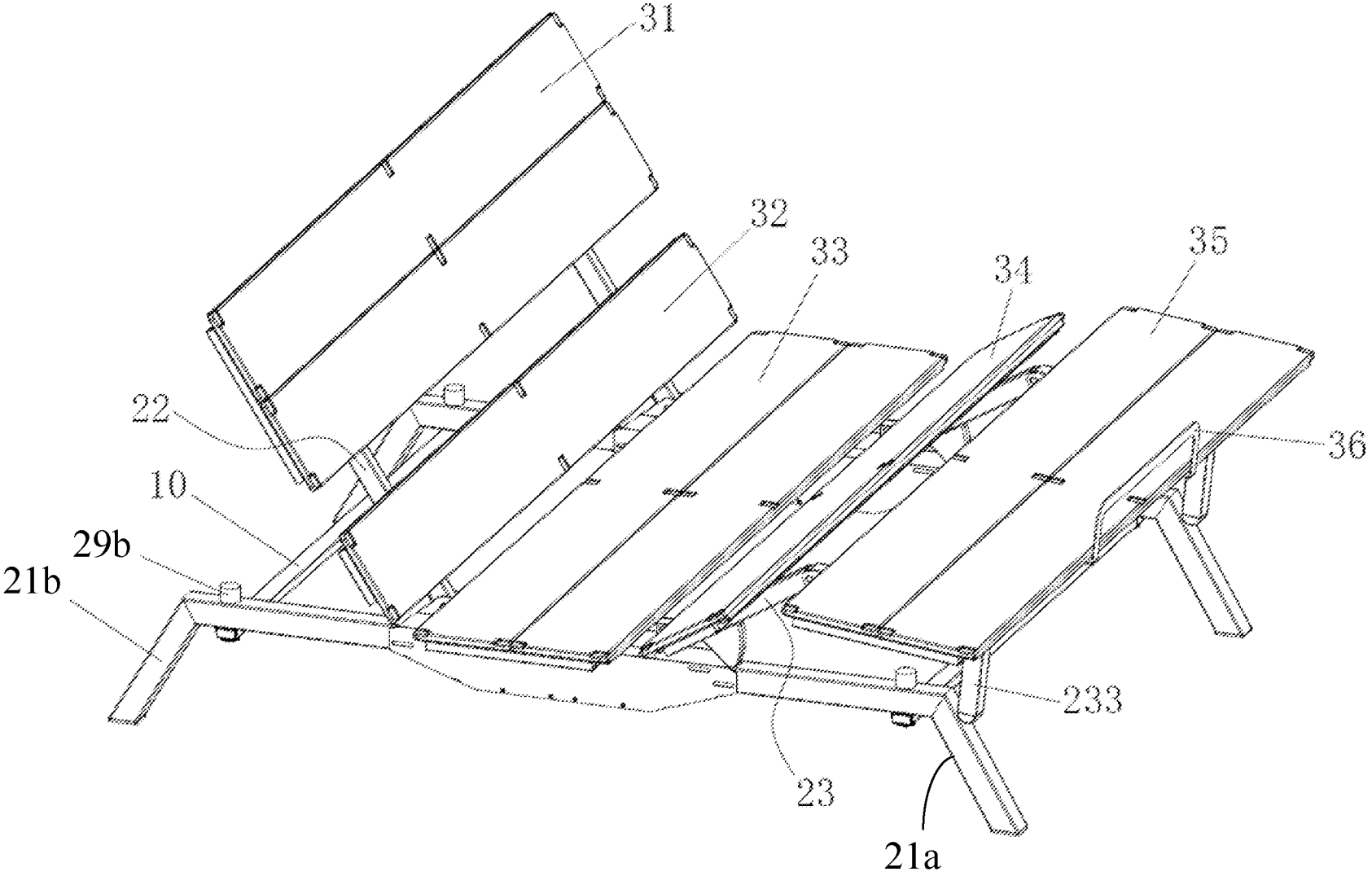
FIG. 2 is a perspective view illustrating the exemplary bed frame of FIG. 1 in a tilted position in accordance with some exemplary embodiments of the present invention.
Figure 3:
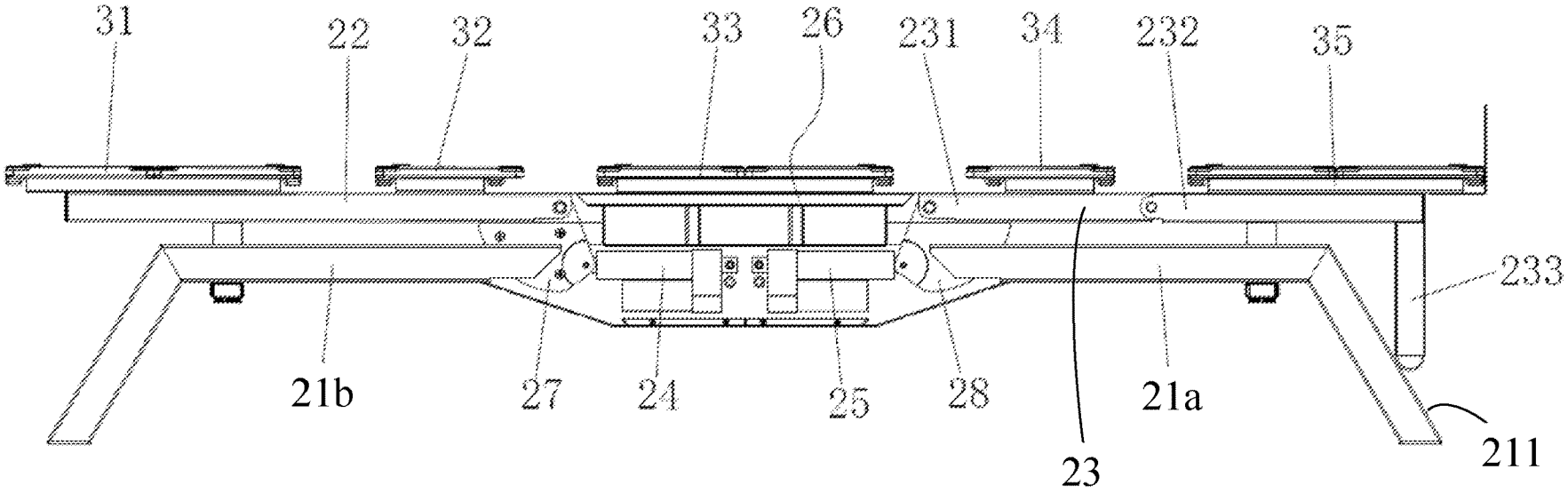
FIG. 3 is a side view illustrating the exemplary bed frame of FIG. 1 in a leveled position in accordance with some exemplary embodiments of the present invention.
Figure 4:
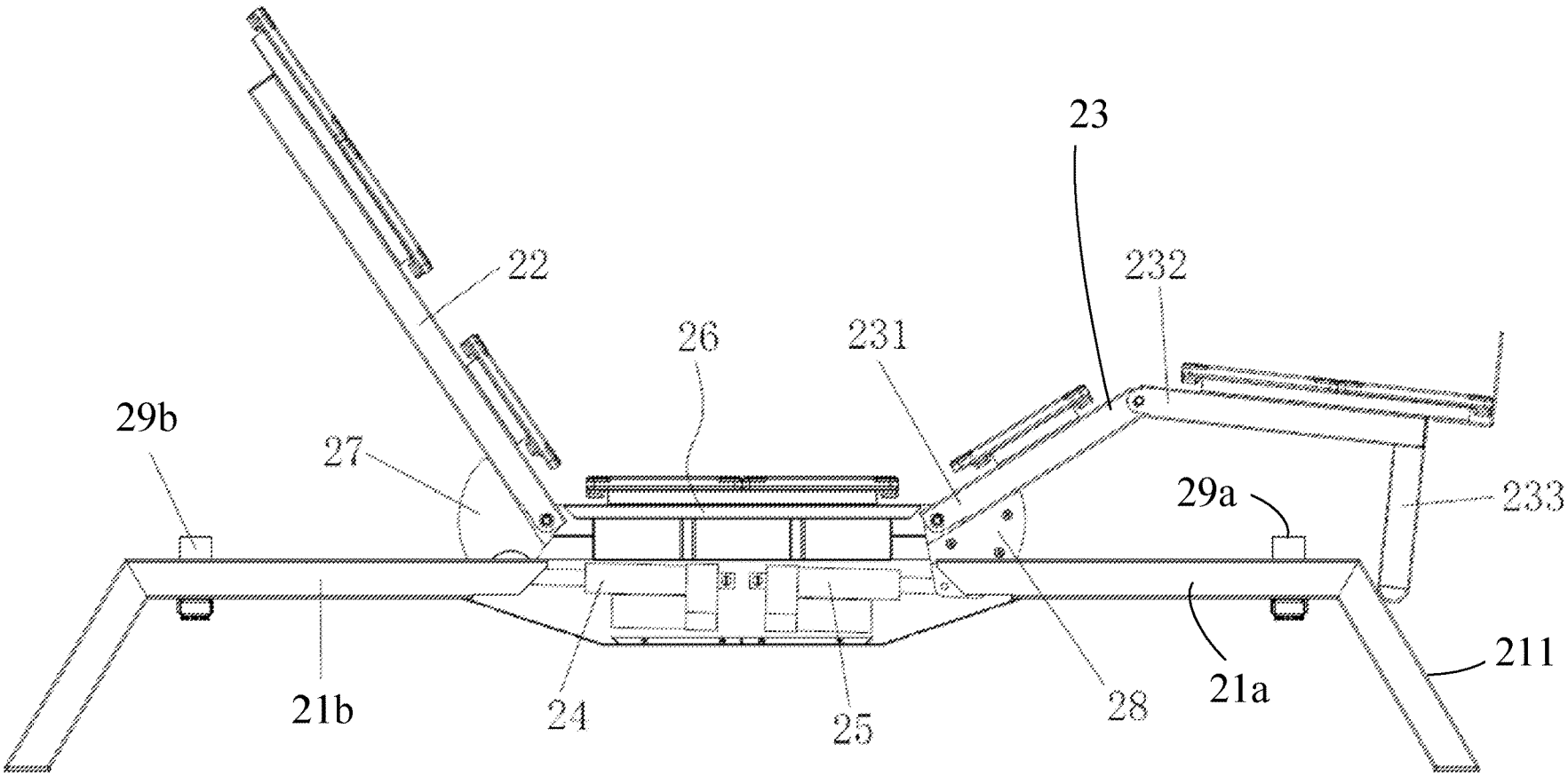
FIG. 4 is a side view illustrating the exemplary bed frame of FIG. 1 in a tilted position in accordance with some exemplary embodiments of the present invention.
Figure 5:
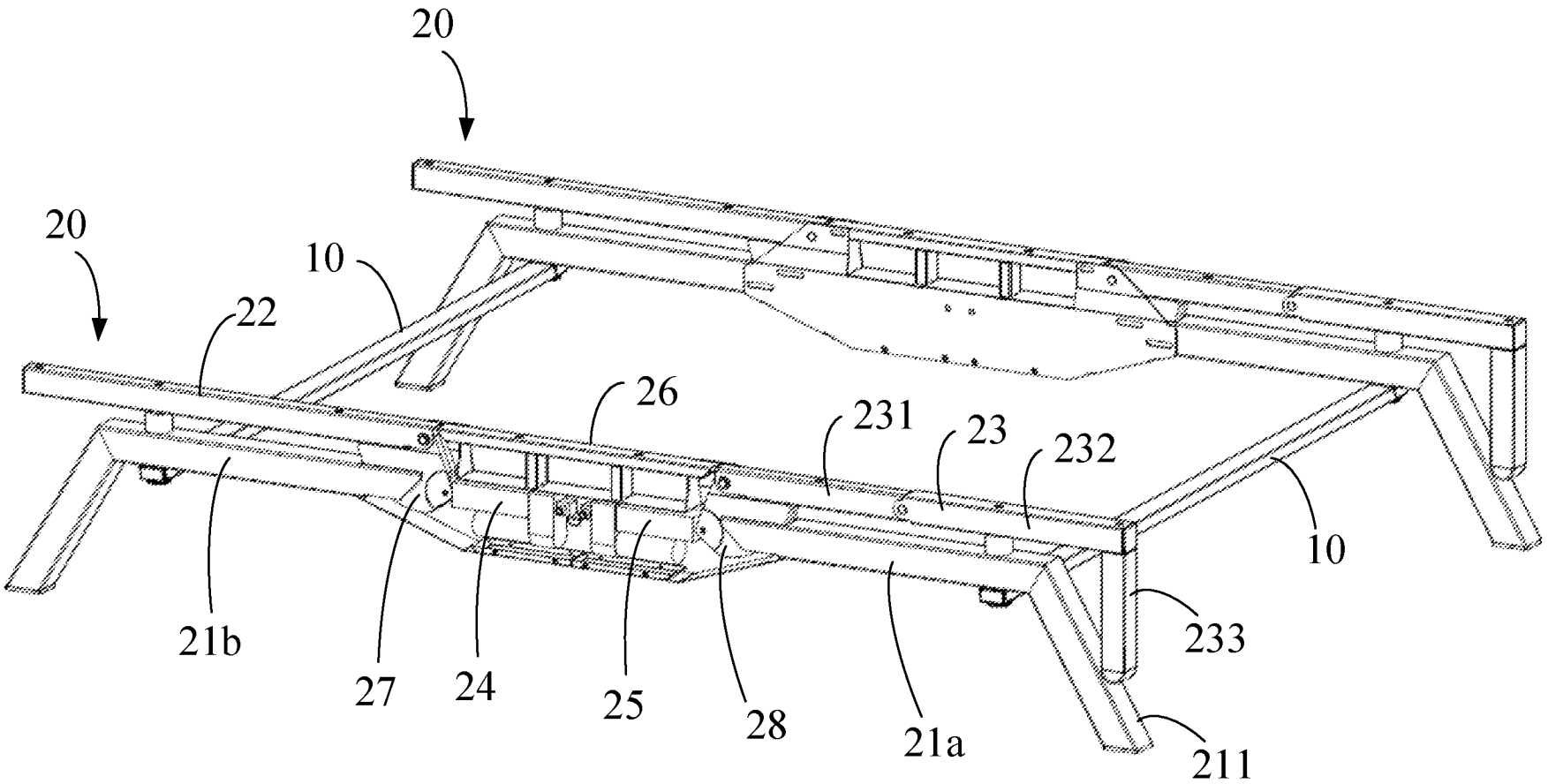
FIG. 5 is a perspective view illustrating the exemplary bed frame of FIG. 1 in a leveled position where panels are not shown in accordance with some exemplary embodiments of the present invention.
Figure 6:
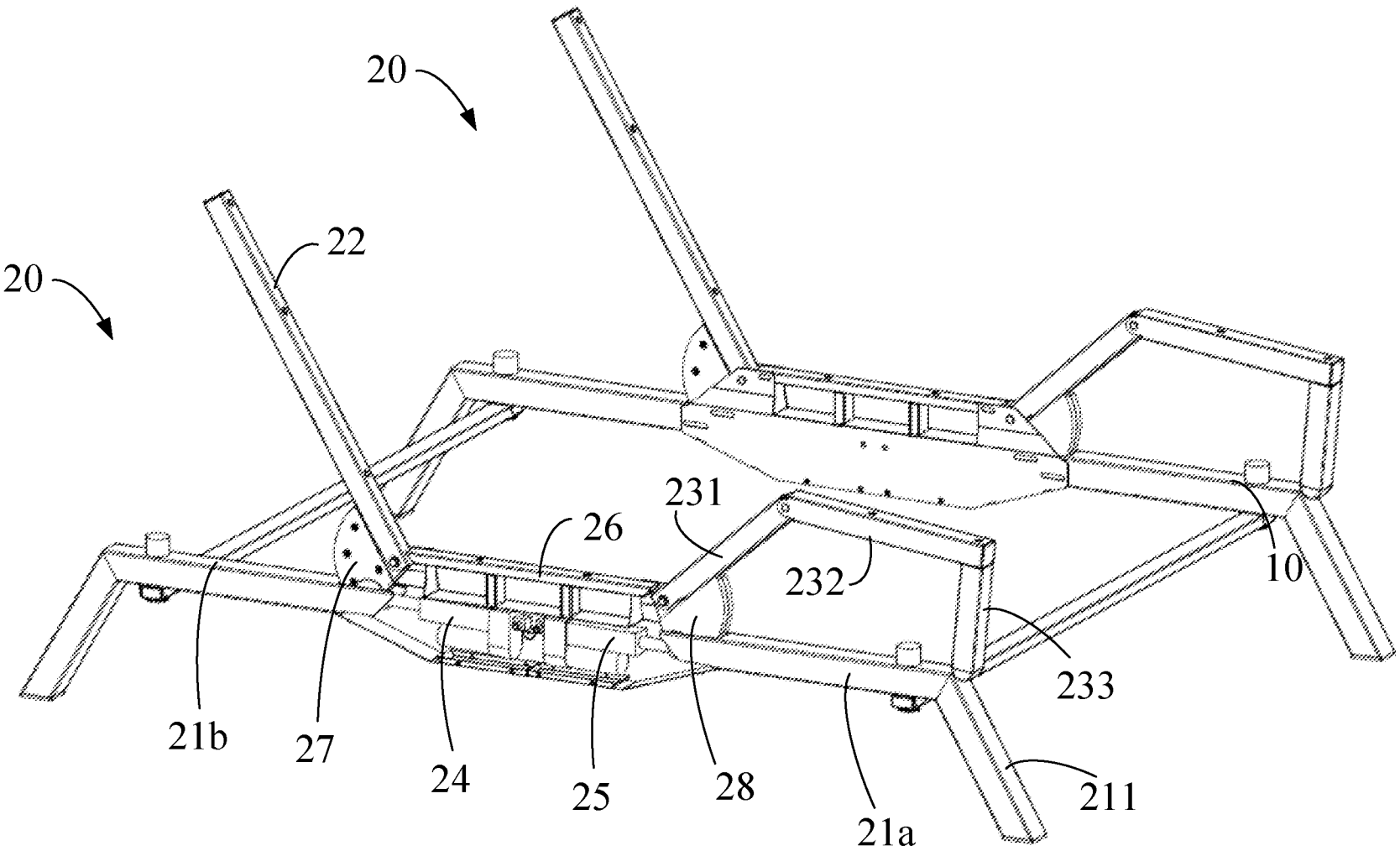
FIG. 6 is a perspective view illustrating the exemplary bed frame of FIG. 1 in a tilted position where panels are not shown in accordance with some exemplary embodiments of the present invention.

As will be apparent to those of skill in the art, the components illustrated in the figures described above are combinable in any useful number and combination. The figures are intended to be illustrative in nature and are not limiting.

DETAILED DESCRIPTION

Reference will now be made in detail to implementations of exemplary embodiments of the present invention as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present invention will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the embodiments, as will be apparent to those skilled in the art. The specific exemplary embodiments described herein are offered by way of example only.

Embodiments of the present invention are described in the context of adjustable bed frames. In general, an adjustable bed frame of the present invention includes one or more structures, each structure having one or more support units that can be adjusted, e.g., leveled, tilted or placed at other suitable positions when desired. In many case, a structure includes a support unit having multiple segments, with some movable relative to each other and some fixed with each other at an angle. A structure also includes a leg unit having a sloped surface to abut a segment of the support unit and thus help to retain the support unit at a desired position.

The adjustable bed frames of the present invention can be of various sizes including but not limited to twin, full, queen and king sizes, and of various shapes including but not limited to rectangles and squares. They can be made of various materials including but not limited to metals such as steel, plastics and woods.

Referring to FIGS. 1-6, there is depicted an exemplary adjustable bed frame 100 in accordance with some exemplary embodiments of the present invention. Adjustable bed frame 100 includes one or more structures, such as structure 20. Adjustable bed frame 100 can include any suitable number of structures 20, including but not limited to one, two, three four, or more than four structures 20. As a non-limiting example, two structures 20 are illustrated. In embodiments with multiple structures, adjacent structures are generally spaced apart from each other, e.g., along a width direction of the adjustable bed frame. In some exemplary embodiments, adjacent structures are connected to each other by one or more connecting members, such as connecting member 10.

Structure 20 includes a mounting unit, such as mounting unit 26. The mounting unit is generally positioned in a middle portion of the structure along a length direction (e.g., head to foot) of the adjustable bed frame. A middle portion of a structure can be but do not have to be a center of the structure.

Structure 20 also includes one or more leg units connected to or formed with mounting unit 26. For instance, in some exemplary embodiments, structure 20 includes leg unit 21*a* coupled or formed with mounting unit 26 at a first side of the adjustable bed frame (e.g., a side for supporting a lower body of a human being). The coupling of leg unit 21*a* with mounting unit 26 can be fixed or movable (e.g., rotatable) and can be direct or indirect. In various exemplary embodiments, leg unit 21*a* includes a sloped surface, such as sloped surface 211, that is oblique relative to a ground when the adjustable bed frame is in use. In some exemplary embodiments, sloped surface 211 is an outer surface of an outwardly inclined portion of leg unit 21*a* (e.g., a leg of the leg unit).

In some exemplary embodiments, structure 20 also includes leg unit 21*b* coupled or formed with mounting unit 26 at a second side of the adjustable bed frame (e.g., a side for supporting an upper body of a human being). Leg unit 21*b* can be configured the same as leg unit 21*a* or differently from leg unit 21*b*. Leg unit 21*b* can also be coupled or formed with leg unit 21*a* as a single unit. In some exemplary embodiments, leg unit 21*a* and leg unit 21*b* are substantially the same and disposed symmetrically with respect to each other.

Structure 20 further includes one or more support units that can be adjusted, e.g., leveled, tilted, or placed at any suitable positions between the leveled and tilted positions when desired. For instance, in some exemplary embodiments, structure 20 includes support unit 23 at a first side of the adjustable bed frame (e.g., the side for supporting a lower body of a human being). Support unit 23 typically includes a plurality of segments, such as segment 231, segment 232, and segment 233. Segment 231 is rotatable with respect to mounting unit 26, e.g., pivotally coupled (directly or indirectly) with mounting unit 26. Segment 232 is pivotally coupled with segment 231. In some embodiments, segment 232 has an end portion coupled with segment 231 and another end portion coupled with segment 233. Segment 233 has an upper portion fixedly coupled or integrally formed with the second segment at an angle, and a lower portion abutting the first sloped surface of the first leg unit. In some exemplary embodiments, segment 232 and segment 233 are substantially perpendicular to each other.

In some exemplary embodiments, structure 20 includes support unit 22 at a second side of the adjustable bed frame (e.g., the side for supporting an upper body of a human being). Support unit 22 is rotatable with respect to mounting unit 26, e.g., pivotally coupled (directly or indirectly) with mounting unit 26. Support unit 22 can be made of a single segment or multiple segments.

The one or more support units, e.g., support unit 22 and support unit 23, can be rotated with respect to mounting unit 26 by one or more driving units. A driving unit can be operable to rotate a single support unit or multiple support units, and may or may not be a component of structure 20. Also, a driving unit, or a portion of a driving unit, can be disposed at mounting unit 26, leg unit 21*a* and/or leg unit 21*b*. As a non-limiting example, it is illustrated that structure 20 includes driving unit 24 and driving unit 25, both disposed at mounting unit 26, to rotate support unit 22 and support unit 23 respectively. In some exemplary embodiments, driving unit 24 or driving unit 25 is an electrical driving unit, e.g., including an electrical motor.

A driving unit can be configured to rotate a support unit directly or via one or more links. As a non-limiting example, it is illustrated that driving unit 24 rotates support unit 22 with respect to mounting unit 26 via link 27, and driving unit 25 rotates support unit 23 with respect to mounting unit 26 via link 28. Link 27 and link 28 can be configured similarly to each other (e.g., having similar shapes, sizes or the like) or differently from each other. By way of example, similar link 27 and link 28 are illustrated. In some exemplary embodiments, link 27 or link 28 has a substantially fan shape.

In some exemplary embodiments, at least one of support unit 22 and link 27 is pivotally connected to mounting unit 26. For instance, in an exemplary embodiment, link 27 is pivotally connected to mounting unit 26 while support unit 22 is fixedly connected to or integrally formed with link 27. In another exemplary embodiment, support unit 22 is pivotally connected to mounting unit 26 while link 27 is fixedly connected to or integrally formed with support unit 23. In a further exemplary embodiment, both support unit 22 and link 27 are pivotally and coaxially connected to mounting unit 26. In such an embodiment, support unit 22 and link 27 can be but do not have to be fixedly connected to or integrally formed with each other. For instance, support unit 22 can sit on link 27 and can rotate with respect to link 27 in one direction, e.g., abutted clockwise by link 27 in FIGS. 5 and 6 such that support unit 22 can rotate away from leg unit 21*b* but not toward leg unit 21*b*.

Link 27 is connected to driving unit 24, which is operable to rotate link 27 relative to mounting unit 26. Rotation of link 27 then causes support unit 22 to rotate relative to mounting unit 26.

Similarly, in some exemplary embodiments, at least one of support unit 23 and link 28 is pivotally connected to mounting unit 26. For instance, in an exemplary embodiment, link 28 is pivotally connected to mounting unit 26 while segment 231 of support unit 23 is fixedly connected to or integrally formed with link 28. In another exemplary embodiment, segment 231 of support unit 23 is pivotally connected to mounting unit 26 while link 28 is fixedly connected to or integrally formed with segment 231 of support unit 23. In a further exemplary embodiment, both segment 231 of support unit 23 and link 28 are pivotally and coaxially connected to mounting unit 26. In such an embodiment, segment 231 of support unit 23 and link 28 can be but do not have to be fixedly connected to or integrally formed with each other. For instance, segment 231 of support unit 23 can sit on link 28 and can rotate with respect to link 28 in one direction, e.g., abutted counterclockwise by link 28 in FIGS. 5 and 6 such that segment 231 of support unit 23 can rotate away from leg unit 21*a* but not toward leg unit 21*a*.

Link 28 is connected to driving unit 25, which is operable to rotate link 28 relative to mounting unit 26. Rotation of link 28 then causes segment 231 (together with segment 232 and segment 233) to rotate relative to mounting unit 26. In the meantime, because segment 232 is pivotally connected to segment 231, segment 232 (together with segment 233) rotates relative to segment 231. Because segment 233 is fixedly coupled or formed with segment 232 and abuts, segment 233 moves along sloped surface 211 of leg unit 21*a* while rotating relative to segment 231 (through segment 232) and rotating relative to mounting unit 26 (through segment 231). In some exemplary embodiments, rotation of segment 232 with respect to segment 231 is opposite to rotation of segment 231 with respect to mounting unit 26. That is, if segment 231 rotates counterclockwise with respect to mounting unit 26, then segment 232 rotates clockwise with respect to segment 231, and vice versa.

Figure 7:
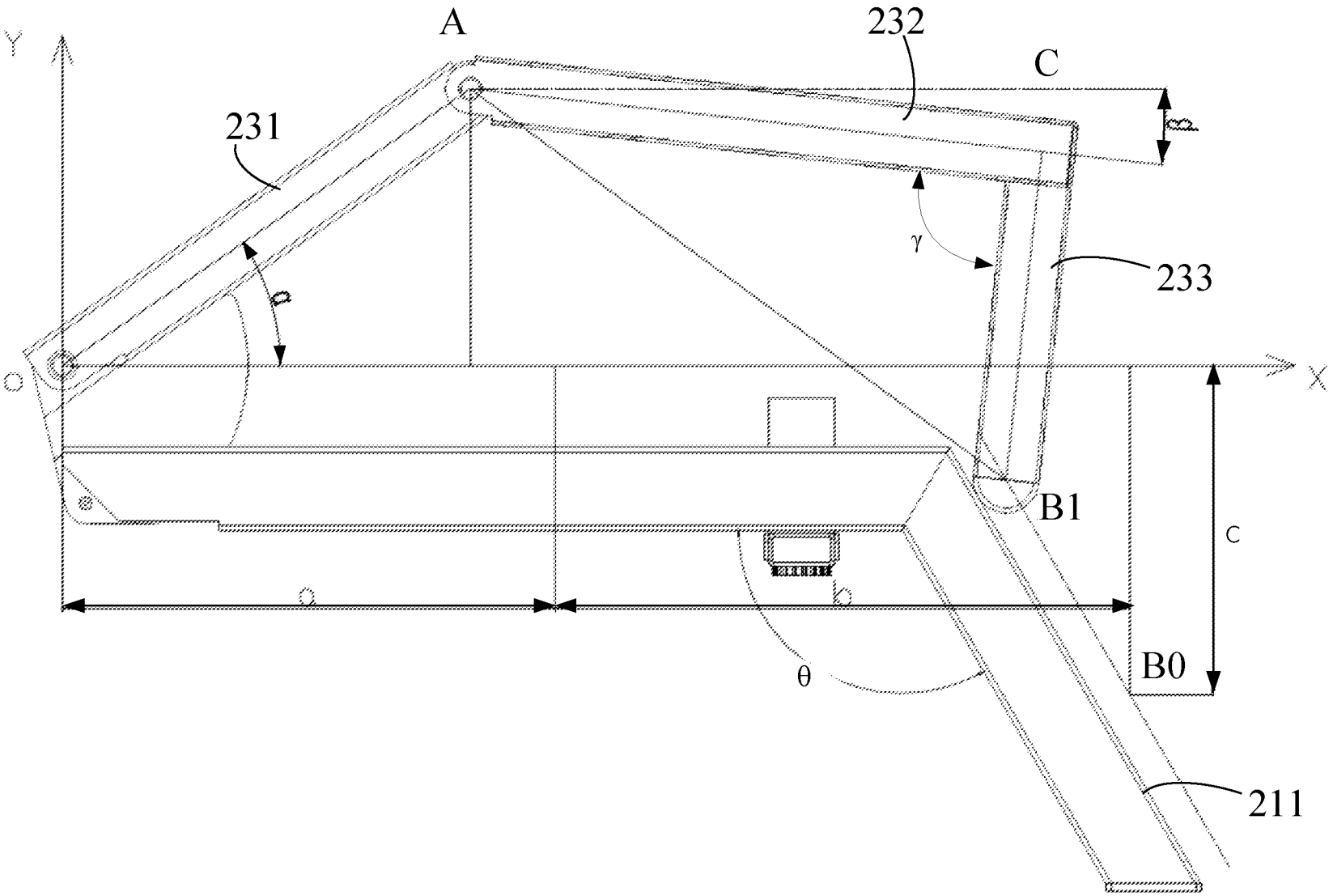
FIG. 7 is a schematic diagram illustrating a relationship between some components of the exemplary bed frame of FIG. 1 in accordance with some exemplary embodiments of the present invention.

The abutting of segment 233 on sloped surface 211 of leg unit 21*a* defines, at least in part, a slope of segment 232, designated by "β" in FIG. 7. In FIG. 7, "a", "b", and "c" designate respectively nominal lengths of segment 231, segment 232 and segment 233. "γ" designates the angle between segment 232 and segment 233. "O" represents the pivotal point of segment 231. "B0" and "B1" represent a lower point of segment 233 when support unit 23 is in a leveled position and a tilted position, respectively. "A" and "C" represent, respectively, the pivotal point and an end point (e.g., a point corresponding to an upper end of segment 233) of segment 232. "θ" designates the angle of sloped surface 211 of leg unit 21*a* with respect to a ground. "α" designates the angle (e.g., rotation) of segment 231 with respect to the ground, and "β" designates the angle (e.g., a slope) of segment 232 with respect to the ground. Because segment 232 and segment 233 are fixed or formed with each other, the shape of triangle A-B1-C is fixed. As such, the angle (e.g., a slope) "β" of segment 232 is determined by the coordinates of "A" and "B1".

The coordinates of "A" are functions of segment 231, and defined by the nominal length and rotation of segment 231 as follows:

$$x_A = a \cdot \cos\alpha; y_A = a \cdot \sin\alpha$$

The coordinates of "B1" are functions of segment 231, segment 232, segment 233 and slope surface 211 of leg unit 21*a*, e.g., functions of "a", "b", "c", "α", "γ" and "θ". For illustration purposes and as a non-limiting example, assume that "y" is 90° (segment 232 and segment 233 are substantially perpendicular to each other). This leads to:

$$(a \cdot \cos\alpha - x_{B1})^2 + (a \cdot \sin\alpha - y_{B1})^2 = b^2 + c^2 \quad (1)$$

wherein $(x_{B1}, y_{B1})$ represent the x and y coordinates of "B1". Because segment 233 abuts slope surface 211 of leg unit

21*a*, the lower point of segment 233 follows a path that can be represented by the following equation:

$$y=\tan\theta\cdot(x-x_{B0})+y_{B0}=\tan\theta\cdot x-\tan\theta\cdot(a+b)-c$$

Since "B1" is on the path, its x and y coordinates ($x_{B1}$, $y_{B1}$) satisfy the following equation:

$$y_{B1}=\tan\theta\cdot x_{B1}-\tan\theta\cdot(a+b)-c \quad (2)$$

By solving equations (1) and (2) together, one can obtain the coordinates of "B1", which can then be used, along with the coordinates of "A", to calculate the angle (e.g., a slope) "β" of segment 232.

The "a", "b", "c", "γ", "θ" or any combination can be optimized to provide better support or comfort at various positions. Once the design is finalized for a particular embodiment, e.g., once the "a", "b", "c", "y" and "θ" are fixed, the angle "β" of segment 232 has a one-on-one relationship with the angle "a" of segment 231, which is the rotation of segment 231 and can be controlled by controlling driving unit 25. At each position between a leveled position (e.g., α=0) and a fully tilted position (e.g., a at the allowed maximum degree), segment 233 abuts slope surface 211 of leg unit 21*a*. This allows support unit 23 to be placed and retained anywhere between the leveled and fully tilted positions as a user desires to support his/her lower body (e.g., legs). This also helps to stabilize support unit 23 and prevent accidental collapse of support unit 23.

In some exemplary embodiments, structure 20 includes one or more cushioning members to prevent support unit 22, support unit 23 or both from rotating beyond a leveled position. For instance, as a non-limiting example, FIGS. 1-4 illustrate cushioning member 29*a* disposed at leg unit 21*a* to prevent support unit 23 from rotating beyond its leveled position, and cushioning member 29*b* disposed at leg unit 21*b* to prevent support unit 22 from rotating beyond its leveled position. However, the present invention is not limited thereto. For instance, cushioning member 29*a* can be disposed at support unit 23 and cushioning member 29*b* can be disposed at support unit 22. In some exemplary embodiments, at least a portion of a cushioning member is made of an elastic material, e.g., silicone, rubber, string, or the like. For instance, in an exemplary embodiment, at least a portion of a cushioning member is a piece made of silicone. The silicone piece can be of a cylindrical, elongated or any other suitable shape.

Bed frame 100 can include additional, optional or alternative components. For instance, in some exemplary embodiments, bed frame 100 includes a plurality of panels coupled with and supported by the one or more structures 20. As a non-limiting example, it is illustrated that bed frame 100 includes a pair of structures 20 and a plurality of panels, such as panel 31 and panel 32 coupled with and supported by support units 22 of the pair of structures, panel 33 coupled with and supported by mounting units 26 of the pair of structures, panel 34 coupled with and supported by segments 231 of support unit 23 of the pair of structures, and panel 35 coupled with and supported by segments 232 of support unit 23 of the pair of structures. However, the present invention is not limited thereto.

In some exemplary embodiments, bed frame 100 includes, additionally or optionally, one or more retainers disposed at one or more panels to retain a mattress or the like in position. For instance, as a non-limiting example, it is illustrated that bed frame 100 includes retainer 36 disposed at panel 35 at the first side of the adjustable bed frame to prevent a mattress or the like from falling off the bed frame.

While bed frame 100 is illustrated with a pair of structure 20, it should be noted that this is by way of example and is non-limiting. An adjustable bed frame can have any suitable number of structures 20. For instance, an adjustable bed frame can have a single structure 20, which may be positioned in the middle portion of the bed frame, made with one or more wider components (e.g., extending in the width direction of the bed frame), combined with other structures, or the like. An adjustable bed frame can also have three, four, or more structures connected to each other in a similar fashion as disclosed herein with respect to the pair of structures or different fashions.

Bed frame 100 is simple and concise. It is also stable and easy to use and has increased strength. In addition, each support unit can be positioned easily and independently at any position between a leveled position and a fully titled position as users desire. As such, bed frame 100 provides improved comfort and satisfaction for users to lie down, watch TV, read books or conduct other leisure activities.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "lower" or "upper", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first side could be termed a second side, and, similarly, a second side could be termed a first side, without changing the meaning of the description, so long as all occurrences of the "first side" are renamed consistently and all occurrences of the "second side" are renamed consistently.

What is claimed is:

1. An adjustable bed frame comprising:

one or more structures, each comprising:

a mounting unit;

a first leg unit coupled or formed with the mounting unit at a first side of the adjustable bed frame, the first leg unit comprising a first sloped surface;

a first support unit comprising first, second and third segments, wherein the first segment is rotatable with respect to the mounting unit, the second segment is pivotally coupled with the first segment, and the third segment has an upper portion fixedly coupled or integrally formed with the second segment and a lower portion abutting the first sloped surface of the first leg unit; and a first driving unit to rotate the first segment of the first support unit with respect to the mounting unit, wherein rotation of the first segment causes the third segment to move along the first sloped surface of the first leg unit, and abutting of the third segment on the first sloped surface of the first leg unit defines, at least in part, a slope of the second segment.

2. The adjustable bed frame of claim 1, wherein the one or more structures comprise a pair of structures spaced apart from each other along a width direction of the adjustable bed frame and connected to each other by one or more connecting members.

3. The adjustable bed frame of claim 1, wherein the first segment of the first support unit is pivotally connected to the mounting unit.

4. The adjustable bed frame of claim 1, wherein each structure further comprises a first link, and the first segment is rotated with respect to the mounting unit by the first driving unit via the first link.

5. The adjustable bed frame of claim 4, wherein the first link has a substantially fan shape.

6. The adjustable bed frame of claim 4, wherein at least one of the first segment and the first link is pivotally connected to the mounting unit.

7. The adjustable bed frame of claim 6, wherein the first segment and the first link are fixedly coupled or formed with each other.

8. The adjustable bed frame of claim 6, wherein the first segment and the first link are pivotally and coaxially connected to the mounting unit.

9. The adjustable bed frame of claim 8, wherein the first segment sits on the first link and is rotatable with respect to the first link in one direction.

10. The adjustable bed frame of claim 1, wherein the first driving unit is disposed at the mounting unit.

11. The adjustable bed frame of claim 1, wherein the first driving unit comprises an electric motor.

12. The adjustable bed frame of claim 1, wherein abutting of the third segment on the first sloped surface of the first leg unit helps to retain the first support unit in any desired position between a leveled position and a tilted position.

13. The adjustable bed frame of claim 1, wherein each structure further comprises:

one or more cushioning members disposed between the first leg unit and the first support unit to prevent the first support unit from rotating beyond a leveled position.

14. The adjustable bed frame of claim 1, wherein each structure further comprises:

a second leg unit coupled with the mounting unit at a second side of the adjustable bed frame; and a second support unit rotatable with respect to the mounting unit.

15. The adjustable bed frame of claim 14, wherein the second support unit is pivotally connected to the mounting unit.

16. The adjustable bed frame of claim 14, wherein each structure further comprises a second driving unit disposed at the mounting unit to rotate the second support unit with respect to the mounting unit.

17. The adjustable bed frame of claim 16, wherein each structure further comprises a second link, and the second driving unit rotates the second support unit with respect to the mounting unit via the second link.

18. The adjustable bed frame of claim 14, wherein each structure further comprises:

one or more cushioning members disposed between the second leg unit and the second support unit to prevent the second first support unit from rotating beyond a leveled position.

19. The adjustable bed frame of claim 1, further comprising one or more panels supported by the one or more mounting units of the one or more structures;

one or more panels supported by the one or more first segments of the one or more first support units of the one or more structures;

one or more panels supported by the one or more second segments of the one or more first support units of the one or more structures;

one or more panels supported by the one or more second support units of the one or more structures; or any combination thereof.

20. The adjustable bed frame of claim 19, further comprising:

a retainer disposed at a panel in the one or more panels supported by the one or more second segments of the one or more first support units of the one or more structures.

* * * * *